US009105232B2

(12) United States Patent
Chun et al.

(10) Patent No.: US 9,105,232 B2
(45) Date of Patent: Aug. 11, 2015

(54) DISPLAY DEVICE, DATA PROCESSING DEVICE FOR THE SAME, AND METHOD THEREOF

(71) Applicants: Byung-Ki Chun, Yongin (KR); Yong-Seok Choi, Yongin (KR); Joo-Hyung Lee, Yongin (KR); Jong-Woong Park, Yongin (KR); Dong-Wook Yang, Yongin (KR)

(72) Inventors: Byung-Ki Chun, Yongin (KR); Yong-Seok Choi, Yongin (KR); Joo-Hyung Lee, Yongin (KR); Jong-Woong Park, Yongin (KR); Dong-Wook Yang, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 201 days.

(21) Appl. No.: 13/946,192

(22) Filed: Jul. 19, 2013

(65) Prior Publication Data

US 2014/0285533 A1 Sep. 25, 2014

(30) Foreign Application Priority Data

Mar. 25, 2013 (KR) ..... 10-2013-0031578

(51) Int. Cl.
*G09G 3/32* (2006.01)

(52) U.S. Cl.
CPC ..... *G09G 3/3208* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,768,539 | B2 * | 8/2010 | Chen | 345/690 |
| 2010/0053137 | A1 * | 3/2010 | Park et al. | 345/211 |
| 2012/0062609 | A1 * | 3/2012 | Jeon | 345/690 |
| 2013/0176498 | A1 * | 7/2013 | Noutoshi et al. | 348/712 |

FOREIGN PATENT DOCUMENTS

| | | | |
|---|---|---|---|
| KR | 10-2006-0114131 | A | 11/2006 |
| KR | 10-2007-0031189 | A | 3/2007 |
| KR | 10-2012-0028007 | A | 3/2012 |
| KR | 10-2012-0039748 | A | 4/2012 |

* cited by examiner

*Primary Examiner* — Kumar Patel
*Assistant Examiner* — Amy C Onyekaba
(74) *Attorney, Agent, or Firm* — Lee & Morse, P.C.

(57) ABSTRACT

A data processing device includes a gamma processor applying a gamma function to grayscale data including red grayscale data, green grayscale data, and blue grayscale data to generate luminance data including red luminance data, green luminance data, and blue luminance data, a first compensation coefficient generator generating a first compensation coefficient, a second compensation coefficient generator calculating a first grayscale ratio of the blue grayscale data and a second grayscale ratio of the red grayscale data, and generating a second compensation coefficient, a data compensation coefficient generator generating a data compensation coefficient by multiplying the first compensation coefficient and the second compensation coefficient, a data compensator generating compensation luminance data by adding the luminance data to a value of the data compensation coefficient multiplied by the luminance data, and an inverse processor generating compensation grayscale data.

23 Claims, 6 Drawing Sheets

DISPLAY DEVICE, DATA PROCESSING DEVICE FOR THE SAME, AND METHOD THEREOF

CROSS-REFERENCE TO RELATED APPLICATION

This application claims priority to and the benefit of Korean Patent Application No. 10-2013-0031578 filed in the Korean Intellectual Property Office on Mar. 25, 2013, the entire contents of which are incorporated herein by reference.

BACKGROUND

1. Field

Embodiments relate to a display device, a data processing device for a display device, and a method thereof.

2. Description of the Related Art

An organic light emitting diode (OLED) display uses an organic light emitting diode (OLED) in which the luminance is controlled by a current or voltage. The organic light emitting diode (OLED) includes an anode layer and a cathode layer forming an electric field, and an organic light emitting material light-emitted by the electric field.

Typically, the organic light emitting diode (OLED) display is classified into a passive matrix OLED (PMOLED) and an active matrix OLED (AMOLED), depending on a mode for driving the organic light emitting diode (OLED). Among these, the AMOLED to be lighted according to the selection for each unit pixel is mainly used in terms of resolution, contrast, and operation speed.

The above information disclosed in this Background section is only for enhancement of understanding of the background of the invention and therefore it may contain information that does not form the prior art that is already known in this country to a person of ordinary skill in the art.

SUMMARY

Embodiments are directed to a data processing device, including a gamma processor applying a gamma function to grayscale data including red grayscale data, green grayscale data, and blue grayscale data to generate luminance data including red luminance data, green luminance data, and blue luminance data, a first compensation coefficient generator generating a first compensation coefficient increasing luminance of the grayscale data as a grayscale decreases, a second compensation coefficient generator calculating a first grayscale ratio of the blue grayscale data and a second grayscale ratio of the red grayscale data for a sum of a grayscale of green grayscale data, blue grayscale data, and red grayscale data, and generating a second compensation coefficient increasing luminance of the blue grayscale data as the first grayscale ratio is decreased and increasing luminance of the red grayscale data as the second grayscale ratio becomes smaller, a data compensation coefficient generator generating a data compensation coefficient by multiplying the first compensation coefficient and the second compensation coefficient, a data compensator generating compensation luminance data by adding the luminance data to a value of the data compensation coefficient multiplied by the luminance data, and an inverse processor generating compensation grayscale data by applying an inverse gamma function to the compensation luminance data.

The first compensation coefficient may include the first blue compensation coefficient for the blue grayscale data and the first red compensation coefficient for the red grayscale data.

The first compensation coefficient may further include the first green compensation coefficient for the green grayscale data.

The second compensation coefficient may include the second blue compensation coefficient generated when the first grayscale ratio is less than 1/3.

The second compensation coefficient may include the second red compensation coefficient generated when the second grayscale ratio is less than 1/3.

The second compensation coefficient generator may calculate the third grayscale ratio of the green grayscale data for the sum of the grayscale and generate the second green compensation coefficient increasing the luminance of the green grayscale data as the third grayscale ratio is decreased.

The second green compensation coefficient may be generated when the third grayscale ratio is less than 1/3.

The second compensation coefficient generator may calculate the third grayscale ratio of the green grayscale data for the sum of the grayscale and generate the second green compensation coefficient increasing the luminance of the green grayscale data as the third grayscale ratio is decreased when the third grayscale ratio is less than 1/3, and decreasing the luminance of the green grayscale data as the third grayscale ratio is increased when the third grayscale ratio is more than 2/3.

The second compensation coefficient may include the second blue compensation coefficient increasing the luminance of the blue grayscale data as the first grayscale ratio is decreased when the first grayscale ratio is less than 1/3, and decreasing the luminance of the blue grayscale data as the first grayscale ratio is increased when the first grayscale ratio is more than 2/3.

The second compensation coefficient may include the second red compensation coefficient including the luminance of the red grayscale data as the second grayscale ratio is decreased when the second grayscale ratio is less than 1/3, and decreasing the luminance of the red grayscale data as the second grayscale ratio is increased when the second grayscale ratio is more than 2/3.

Embodiments are also directed to a data processing device, including a first compensation coefficient generator generating a first compensation coefficient increasing luminance of a grayscale data as a grayscale decreases, a second compensation coefficient generator calculating a first grayscale ratio of blue grayscale data and a second grayscale ratio of red grayscale data for a sum of a grayscale of green grayscale data, blue grayscale data, and red grayscale data included in the grayscale data, and generating a second compensation coefficient increasing luminance of the blue grayscale data as the first grayscale ratio is decreased and increasing luminance of the red grayscale data as the second grayscale ratio becomes smaller, a data compensation coefficient generator generating a data compensation coefficient by multiplying the first compensation coefficient and the second compensation coefficient, and a data compensator generating compensation luminance data by adding luminance data to a value of the data compensation coefficient multiplied by the luminance data.

Embodiments are also directed to a method of processing data, including applying a gamma function to grayscale data to generate luminance data, generating a first compensation coefficient increasing luminance of the grayscale data as a grayscale decreases, calculating a first grayscale ratio of one of blue grayscale data and red grayscale data for a sum of a grayscale of green grayscale data, blue grayscale data, and red grayscale data, and generating a second compensation coefficient increasing luminance of one of the blue grayscale data and the red grayscale data as the first grayscale ratio is decreased, multiplying the first compensation coefficient and the second compensation coefficient to generate a data compensation coefficient, adding the luminance data to a value of the data compensation coefficient multiplied by the luminance data to generate compensation luminance data, and applying an inverse gamma function to the compensation luminance data to generate compensation grayscale data.

The generating of the first compensation coefficient may include generating a first blue compensation coefficient for the blue grayscale data and a first red compensation coefficient for the red grayscale data.

The generating of the first compensation coefficient may include generating a first green compensation coefficient for the green grayscale data.

The generating of the second compensation coefficient may include generating a second compensation coefficient increasing luminance of one of the blue grayscale data and the red grayscale data as the first grayscale ratio is decreased when the first grayscale ratio is less than 1/3.

The generating of the second compensation coefficient may include generating a second compensation coefficient decreasing the luminance of one of the blue grayscale data and the red grayscale data as the first grayscale ratio is increased when the first grayscale ratio is more than 2/3.

The generating of the second compensation coefficient may include calculating the second grayscale ratio of the other of the blue grayscale data and the red grayscale data for the sum of the grayscale of the red grayscale data, the green grayscale data, and the blue grayscale data included the grayscale data, and generating the second compensation coefficient increasing the luminance of the other of the blue grayscale data and the red grayscale data as the second grayscale ratio is decreased when the second grayscale ratio is less than 1/3.

The generating of the second compensation coefficient may include generating the second compensation coefficient decreasing the luminance of the other of the blue grayscale data and the red grayscale data as the second grayscale ratio is increased when the second grayscale ratio is more than 2/3.

The generating of the second compensation coefficient may include calculating a third grayscale ratio of the green grayscale data for the grayscale sum, and generating the second compensation coefficient increasing the luminance of the green grayscale data as the third grayscale ratio is decreased when the third grayscale ratio is less than 1/3.

The generating of the second compensation coefficient further may include generating the second compensation coefficient decreasing the luminance of the green grayscale data as the third grayscale ratio is increased when the third grayscale ratio is more than 2/3.

Embodiments are also directed to a display device, including a plurality of pixels, and a data processor generating compensation grayscale data by compensating grayscale data for an image display in the plurality of pixels, wherein the data processor generates a first compensation coefficient increasing luminance of the grayscale data as a grayscale decreases, calculates a first grayscale ratio of blue grayscale data and a second grayscale ratio of red grayscale data for a grayscale sum of red grayscale data, green grayscale data, and blue grayscale data included in the grayscale data, generates a second compensation coefficient increasing luminance of the blue grayscale data as the first grayscale ratio is decreased and increasing luminance of the red grayscale data as the second grayscale ratio is decreased, generates a data compensation coefficient by multiplying the first compensation coefficient and the second compensation coefficient, and compensates the grayscale data by using the data compensation coefficient.

The data processor may generate the luminance data by applying a gamma function to the grayscale data, add luminance data to a value of the data compensation coefficient multiplied by the luminance data to generate the compensation luminance data, and apply an inverse gamma function to compensation luminance data to generate the compensation grayscale data.

The data processor may add the grayscale data to a value of the data compensation coefficient multiplied by the grayscale data to generate the compensation grayscale data.

BRIEF DESCRIPTION OF THE DRAWINGS

Features will become apparent to those of skill in the art by describing in detail example embodiments with reference to the attached drawings in which.

DETAILED DESCRIPTION

Figure 1:
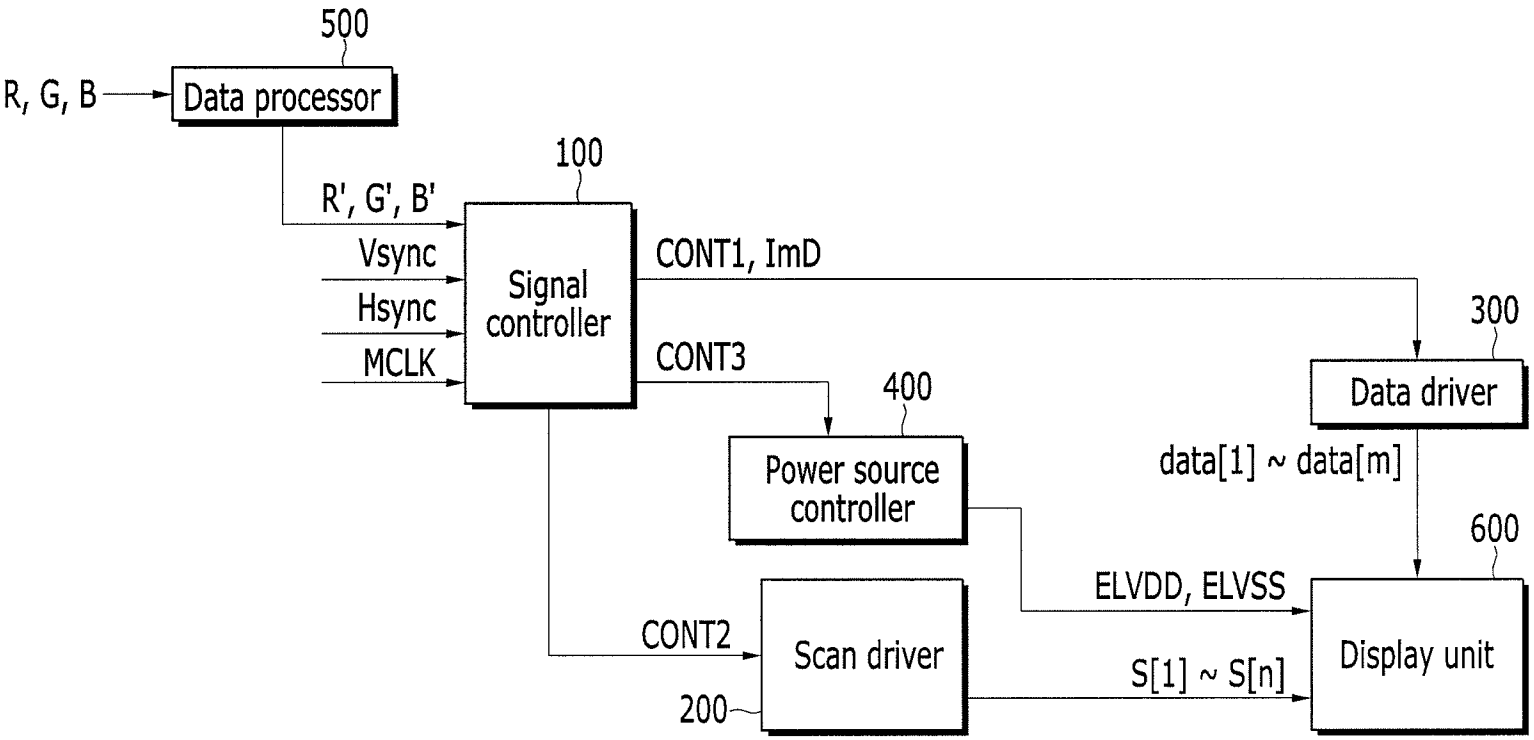
FIG. 1 is a block diagram of a display device according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. Like reference numerals refer to like elements throughout. Only elements of other embodiments other than those of the first embodiment may be described.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an example embodiment.

Referring to FIG. 1, a display device 10 includes a signal controller 100, a scan driver 200, a data driver 300, a power supply unit 400, a data processor 500, and a display unit 600.

In the present example embodiment, the data processor 500 generates a data compensation coefficient to compensate a color twist by a leakage current and a load effect, and applies the data compensation coefficient to video signals R, G, and B input from the outside to output compensation video signals R', G', and B'. The video signals R, G, and B include luminance information of a plurality of sub-pixels. Luminance has a grayscale having a predetermined number, for example $1024=2^{10}$, $256=2^{8}$, or $64=2^{6}$.

The signal controller 100 receives the compensation video signals R', G', and B' and a synchronization signal. The synchronization signal includes a horizontal synchronization signal Hsync, a vertical synchronization signal Vsync, and a main clock signal MCLK. The signal controller 100 generates first to third driving control signals CONT1 to CONT3 and an image data signal ImD according to the compensation video signals R', G', and B', the horizontal synchronization signal Hsync, the vertical synchronization signal Vsync, and the main clock signal MCLK. The signal controller 100 divides the compensation video signals R', G', and B' by a frame unit according to the vertical synchronization signal Vsync and divides the compensation video signal R', G', and B' by a scan line unit according to the horizontal synchronization signal Hsync to generate the image data signal ImD. The signal controller 100 transmits the image data signal ImD to the data driver 300 along with the first driving control signal CONT1.

In FIG. 1, the data processor 500 is separated from the signal controller 100; however, the data processor 500 may be included in the signal controller 100.

The display unit 600 has a display area including a plurality of pixels. The plurality of pixels may respectively include a red sub-pixel, a green sub-pixel, and a blue sub-pixel. A plurality of scan lines that are substantially extended in a row direction and substantially parallel with each other, and a plurality of data lines, a plurality of power lines, a plurality of compensation control lines, and a plurality of link control lines that are substantially extended in a column direction and substantially parallel with each other are formed in the display unit 600 to be connected to the plurality of pixels. The plurality of pixels are arranged substantially in a matrix format.

The scan driver 200 is connected to a plurality of scan lines, and generates a plurality of scan signals S[1]-S[n] according to the second driving control signal CONT2. The scan driver 200 may sequentially apply the scan signals S[1]-S[n] of the gate-on voltage to a plurality of scan lines.

The data driver 300 is connected to a plurality of data lines, and samples and holds the image data signal ImD input according to the first driving control signal CONT1 and transmits a plurality of data signals data[1]-data[m] to a plurality of data lines. The data driver 300 applies the data signals data[1]-data[m] having a predetermined voltage range to a plurality of data lines by corresponding with the scan signals S[1]-S[n] of the gate-on voltage.

The power supply unit 400 determines a level of the first power source voltage ELVDD and the second power source voltage ELVSS according to the third driving control signal CONT3 to supply the level to a plurality of power source lines connected to a plurality of sub-pixels. The first power source voltage ELVDD and the second power source voltage ELVSS provide the driving current of a plurality of sub-pixels.

The data processing device 500 compensating the color twist by the leakage current and the load effect and a driving method thereof according to example embodiments will be described.

Figure 2:
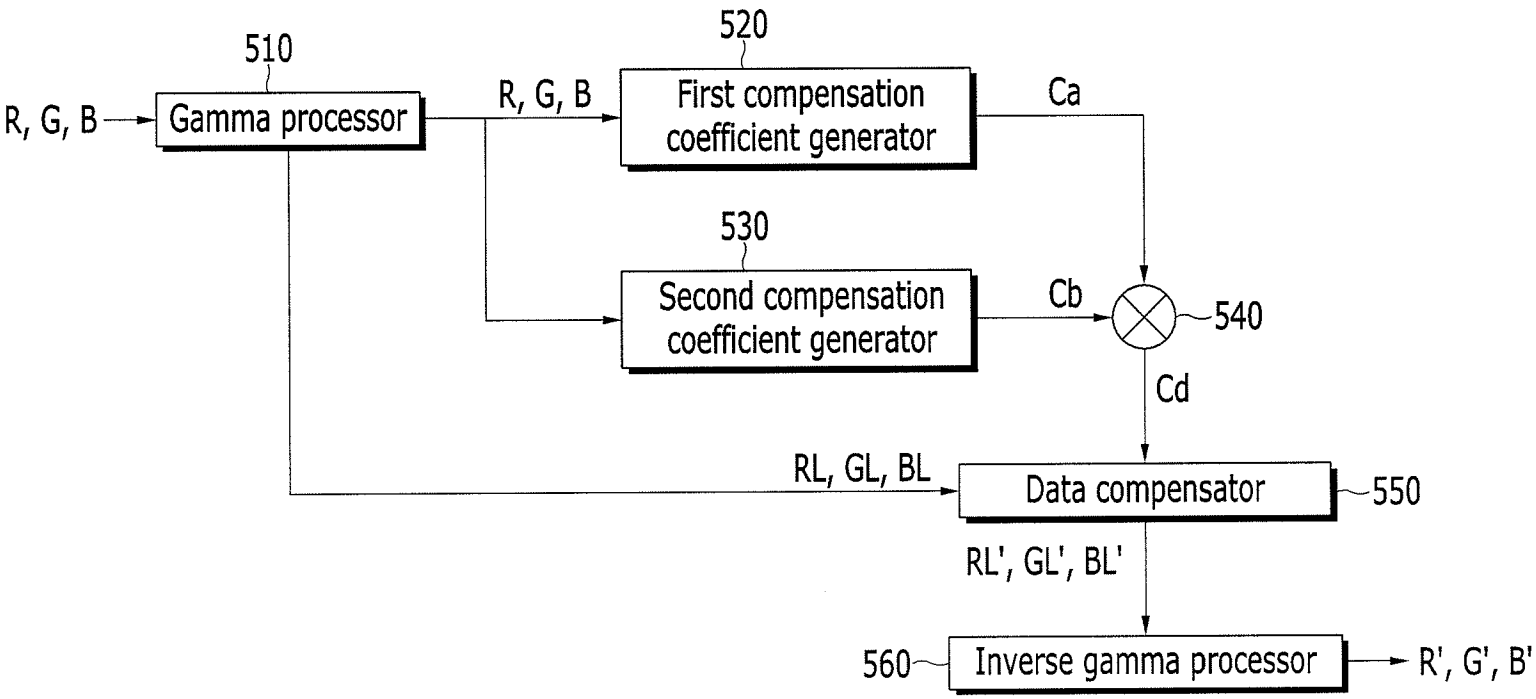
FIG. 2 is a block diagram of a data processing device according to an example embodiment.

FIG. 2 is a block diagram of a data processing device according to an example embodiment.

In the example embodiment shown in FIG. 2, the data processing device 500 includes a gamma processor 510, a first compensation coefficient generator 520, a second compensation coefficient generator 530, a data compensation coefficient generator 540, a data compensator 550, and an inverse gamma processor 560.

The gamma processor 510 receives video signals R, G, and B from the outside. The video signals R, G, and B may be grayscale data representing the grayscale of each sub-pixel. Next, it is assumed that the video signals R, G, and B have the grayscale data R, G, and B having 0-255 grayscales. At this time, the compensation video signals R', G', and B' become the compensation grayscale data R', G', and B' having 0-255 grayscales.

The gamma processor 510 converts the grayscale data R, G, and B into luminance data RL, GL, and BL by applying a gamma function ($f=x^{2.2}$). That is, the gamma processor 510 linearizes the video signals R, G, and B into the luminance data RL, GL, and BL by applying the gamma function ($f=x^{2.2}$).

Equation 1 is an example of linearizing the grayscale data R, G, and B into the luminance data RL, GL, and BL by applying the gamma function ($f=x^{2.2}$).

$$RL=\alpha\left(\frac{R}{255}\right)^{2.2}$$
$$GL=\alpha\left(\frac{G}{255}\right)^{2.2}$$
$$BL=\alpha\left(\frac{B}{255}\right)^{2.2}$$

Equation 1)

Here, RL is red luminance data, GL is green luminance data, BL is blue luminance data, R is red grayscale data, G is green grayscale data, B is blue grayscale data, and $\alpha$ is a conversion coefficient.

The gamma processor 510 transmits the luminance data RL, GL, and BL to the data compensator 550. Also, the gamma processor 510 transmits the grayscale data R, G, and B to the first compensation coefficient generator 520 and the second compensation coefficient generator 530.

The first compensation coefficient generator 520 generates the first compensation coefficient by using the grayscale data R, G, and B. The first compensation coefficient is a compensation coefficient to compensate the color twist by the leakage current. The color twist by the leakage current is increased closer to the low grayscale, i.e., the color twist by the leakage current increases as the grayscale decreases.

Next, a method of generating the first compensation coefficient in the first compensation coefficient generator 520 will be described with reference to FIGS. 3 and 4.

Figure 3:
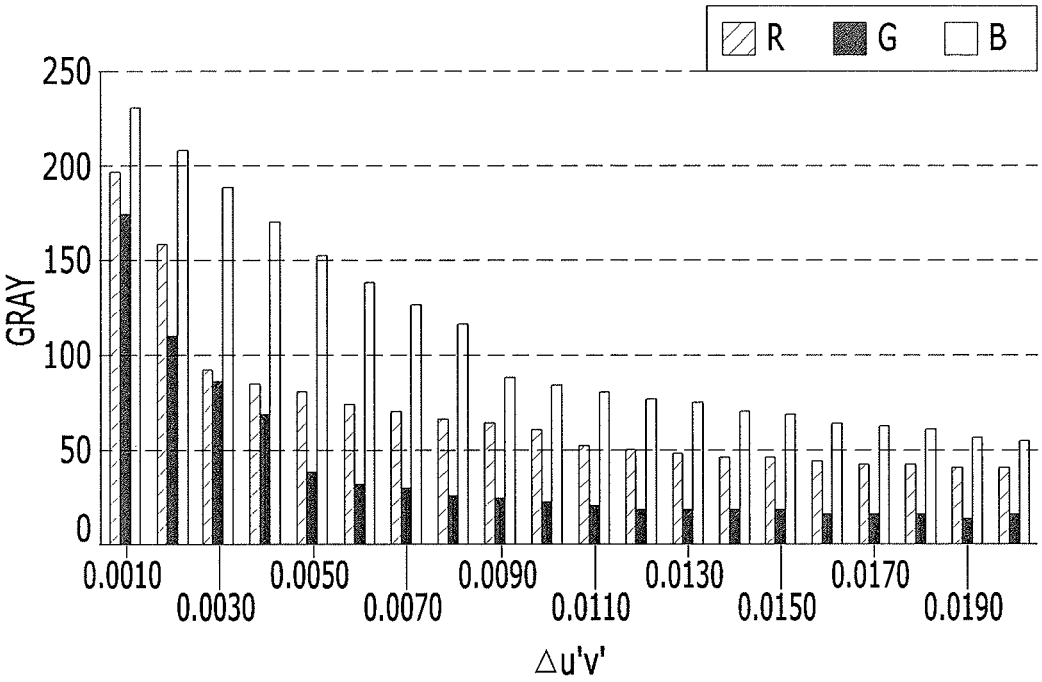
FIG. 3 is a graph showing a relationship of a grayscale and a color coordinate error.

FIG. 3 is a graph showing a relationship of a grayscale and a color coordinate error. FIG. 4 is a graph to explain a method of generating the first compensation coefficient according to an example embodiment.

Referring to FIG. 3, a transverse axis represent a color coordinate error ($\Delta u'v'$) of an actual color coordinate compared with a standard color coordinate on the color coordinate, and a longitudinal axis represents a grayscale (gray). For the red grayscale data R, the green grayscale data G, and the blue grayscale data B, the color coordinate error ($\Delta u'v'$) are all increased closer to the low grayscale.

For example, in the case of the blue grayscale data B, if the color coordinate error ($\Delta u'v'$) is within 0.004, the blue grayscale data B must be more than 170 grayscale, and if the color coordinate error (Δu'v') is within 0.012, the blue grayscale data B must be more than 80 grayscale.

Also, the color coordinate error (Δu'v') is largest in the blue grayscale data B and is smallest in the green grayscale data G. That is, the blue grayscale data B and the red grayscale data R are largely influenced to the color coordinate error (Δu'v'), however the green grayscale data (G) is slightly influenced to the color coordinate error (Δu'v'). Meanwhile, the green occupies the entire luminance by about 75%.

Accordingly, by controlling the blue grayscale data B and the red grayscale data R that are relatively largely influenced to the color coordinate error (Δu'v'), the color coordinate may be compensated. At this time, the green occupies about 75% of the entire luminance such that the entire luminance is not largely changed. The color coordinates may be compensated by a method in which the luminance of the blue grayscale data B and the red grayscale data R is increased closer to the low grayscale, and the luminance of the blue grayscale data B and the red grayscale data R is decreased closer to the high grayscale.

Also, as well as the blue grayscale data B and the red grayscale data R, the color coordinates may be compensated by controlling the green grayscale data G. In this case, the color coordinates may be compensated by a method in which the luminance of the blue grayscale data B, the red grayscale data R, and the green grayscale data G is increased closer to the low grayscale, and the luminance of the blue grayscale data B, the red grayscale data R, and the green grayscale data G is decreased closer to the high grayscale.

Figure 4:
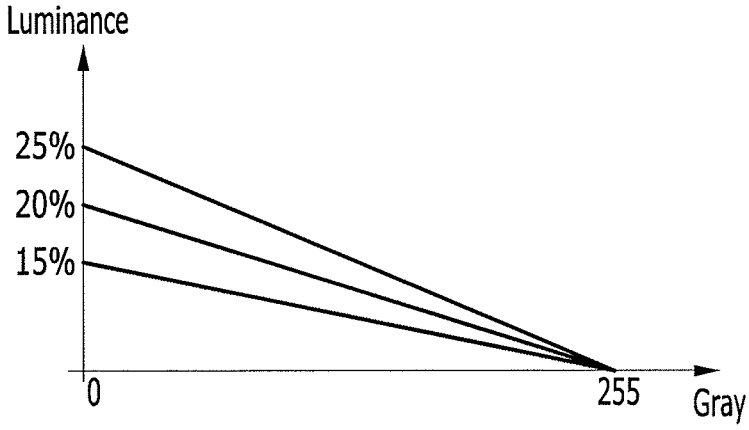
FIG. 4 is a graph to explain a method of generating a first compensation coefficient according to an example embodiment.

Referring to FIG. 4, a luminance increasing ratio is 0% in the 255 grayscale, the luminance increasing ratio is increased closer to the low grayscale, and three luminance increasing ratios becomes 15%, 20% and 25% in the 0 grayscale. Here, three luminance increasing ratio graphs are given as an example for explanation, and the luminance increasing ratio graph may be experimentally determined by considering each color coordinate error (Δu'v') of the blue grayscale data B, the red grayscale data R, and the green grayscale data G.

For example, since the color coordinate error (Δu'v') of the blue grayscale data B is largest, by applying the first luminance increasing ratio graph in which the luminance increasing ratio is 25% in the 0 grayscale for the blue grayscale data (B), the first blue compensation coefficient Ca(B) for the blue grayscale data B may be calculated. Also, by applying the second luminance increasing ratio graph in which the luminance increasing ratio is 20% in the 0 grayscale for the red grayscale data B, the first red compensation coefficient Ca(R) for the red grayscale data B may be calculated.

If, when compensating the color coordinates by controlling the green grayscale data G as well as the blue grayscale data B and the red grayscale data R, by applying the third luminance increasing ratio graph in which the luminance increasing ratio is 15% in 0 the grayscale for the green grayscale data G, the first green compensation coefficient Ca(G) for the green grayscale data G may be calculated.

Equation 2 shows a method of generating the first compensation coefficient Ca by using the grayscale data R, G, and B. The first compensation coefficient Ca includes the first blue compensation coefficient Ca(B), the first red compensation coefficient Ca(R), and the first green compensation coefficient Ca(G). A graph of FIG. 4 may be expressed by Equation 2.

$$Ca(B) = \frac{255 - B}{255} \times \frac{Lb}{100} \quad \text{Equation 2)}$$

-continued $$Ca(R) = \frac{255 - R}{255} \times \frac{Lr}{100}$$

$$Ca(G) = \frac{255 - G}{255} \times \frac{Lg}{100}$$

Here, Ca(B) is the first blue compensation coefficient for the blue grayscale data B, Ca(R) is the first red compensation coefficient for the red grayscale data R, Ca(G) is the first green compensation coefficient for the green grayscale data (G), Lb is a maximum luminance increasing ratio value of the first luminance increasing ratio graph, Lr is a maximum luminance increasing ratio value of the second luminance increasing ratio graph, and Lg is a maximum luminance increasing ratio value of the third luminance increasing ratio graph.

As described above, the first compensation coefficient Ca is a compensation coefficient increasing the luminance of the grayscale data R, G, and B closer to the low grayscale, i.e., the first compensation coefficients Ca increases the luminance of the grayscale data R, G, and B as the grayscale value becomes lower.

Again referring to FIG. 2, the second compensation coefficient generator 530 generates the second compensation coefficient by using the grayscale data R, G, and B. The second compensation coefficient is the compensation coefficient to compensate the color twist by the load effect.

In the red sub-pixel, the green sub-pixel, and the blue sub-pixel in one pixel, the smaller current than the intended current amount flows in the sub-pixel emitting the light with a relatively small current amount by the influence of the load effect, and the larger current than the intended current amount flows in the sub-pixel emitting the light with a relatively large current amount. That is, the sub-pixel applied with the grayscale data having the grayscale ratio that is decreased by the load effect becomes darker and the sub-pixel applied with the grayscale data having the large grayscale ratio becomes brighter.

Accordingly, to compensate the color coordinate error by the load effect, the second compensation coefficient generator 530 may generate the second compensation coefficient according to the grayscale ratio of the red grayscale data R, the green grayscale data G, and the blue grayscale data B. The second compensation coefficient generator 530 may generate the second compensation coefficient for the luminance of the grayscale data having the smaller grayscale ratio to be increased.

Next, a method of generating the second compensation coefficient in the second compensation coefficient generator 530 will be described with reference to FIGS. 5 and 6.

Figure 5:
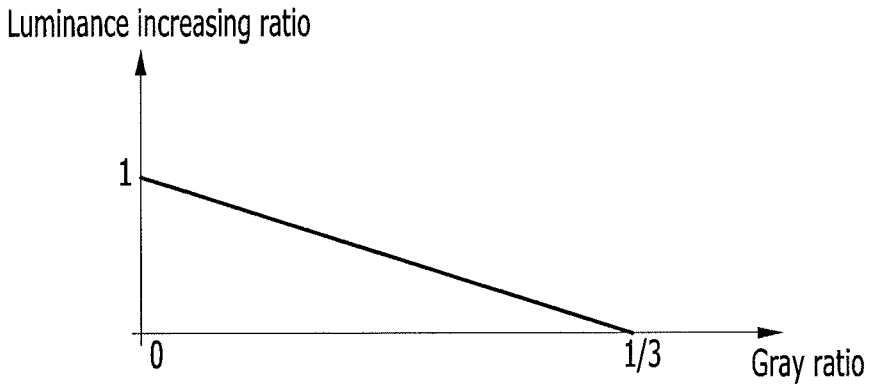
FIG. 5 is a graph to explain a method of generating a second compensation coefficient according to an example embodiment.

FIG. 5 is a graph to explain a method of generating the second compensation coefficient according to an example embodiment.

Referring to FIG. 5, a grayscale ratio is a ratio of the corresponding grayscale data for a grayscale sum of the red grayscale data R, the green grayscale data G, and the blue grayscale data B.

Equation 3 represents each grayscale ratio of the red grayscale data R, the green grayscale data G, and the blue grayscale data B:

$$Kr = \frac{R}{R + G + B} \quad \text{Equation 3)}$$

$$Kg = \frac{G}{R + G + B}$$

-continued $$Kb = \frac{B}{R+G+B}$$

Here, Kr represents the grayscale ratio of the red grayscale data R, Kg represents the grayscale ratio of the green grayscale data G, and Kb represents the grayscale ratio of the blue grayscale data B.

When the grayscale ratio (Kr) of the red grayscale data R is 0, the luminance increasing ratio becomes 1, the luminance increasing ratio is decreased as the grayscale ratio (Kr) of the red grayscale data R is increased, and when the grayscale ratio (Kr) of the red grayscale data R is 1/3, the luminance increasing ratio becomes 0. When the grayscale ratio (Kr) of the red grayscale data R is more than 1/3, the luminance increasing ratio becomes 0.

By the same method, the luminance increasing ratio of the green grayscale data G is determined by the grayscale ratio (Kg) of the green grayscale data G and the luminance increasing ratio of the blue grayscale data B is determined according to the grayscale ratio (Kb) of the blue grayscale data B.

Equation 4 represents a method of generating the second compensation coefficient Cb by using the grayscale ratios Kr, Kg, and Kb. The second compensation coefficient Cb includes the second blue compensation coefficient Cb(B), the second red compensation coefficient Cb(R), and the second green compensation coefficient Cb(G). The graph of FIG. 5 may be expressed by Equation 4.

$$Cb(B) = 1 - \frac{1}{Kb_{max}} \times Kb \qquad \text{Equation 4)}$$

$$Cb(R) = 1 - \frac{1}{Kr_{max}} \times Kr$$

$$Cb(G) = 1 - \frac{1}{Kg_{max}} \times Kg$$

Here, Cb(B) represents the second blue compensation coefficient for the blue grayscale data B, Cb(R) represents the second red compensation coefficient for the red grayscale data R, Cb(G) represents the second green compensation coefficient for the green grayscale data G, Kb_max represents the maximum grayscale ratio 1/3 of the blue grayscale data B, Kr_max represents the maximum grayscale ratio 1/3 of the red grayscale data R, and Kg_max represents the maximum grayscale ratio 1/3 of the green grayscale data G.

Equation 4 is applied when each grayscale ratio Kr, Kg, and Kb of the red grayscale data R, the green grayscale data G, and the blue grayscale data B is less than 1/3. The second compensation coefficient Cb generated by Equation 4 is the compensation coefficient for increasing the luminance of the corresponding grayscale data as the grayscale ratio is decreased.

When compensating the color coordinates by controlling the blue grayscale data B and the red grayscale data R, the second blue compensation coefficient Cb(B) and the second red compensation coefficient Cb(R) may be calculated.

When compensating the color coordinates by controlling the green grayscale data G as well as the blue grayscale data B and the red grayscale data R, the second blue compensation coefficient Cb(B), the second red compensation coefficient Cb(R), and the second green compensation coefficient Cb(G) may be calculated.

Figure 6:
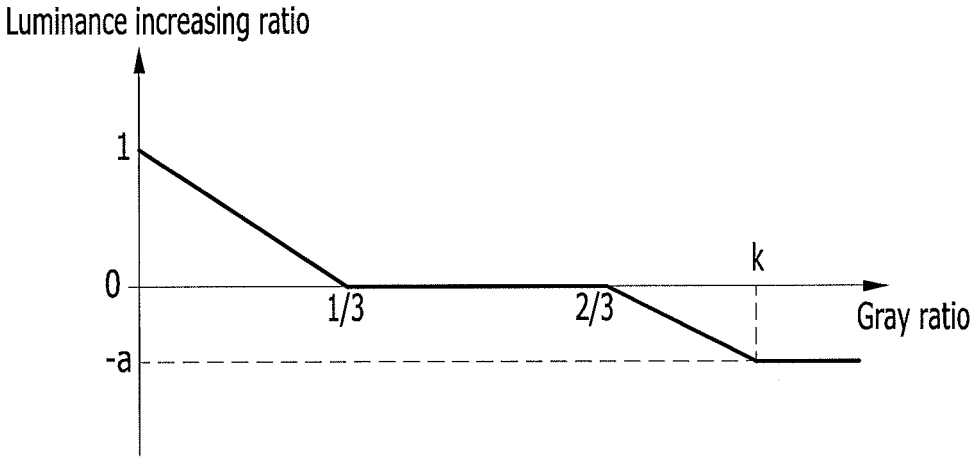
FIG. 6 is a graph to explain a method of generating the second compensation coefficient according to another example embodiment.

FIG. 6 is a graph to explain a method of generating the second compensation coefficient according to another example embodiment.

Referring to FIG. 6, a sub-pixel applied with the grayscale data having the grayscale ratio that is decreased by the load effect becomes darker and the sub-pixel applied with the grayscale data having the large grayscale ratio becomes brighter, however the luminance of the grayscale data having the large grayscale ratio is not compensated in FIG. 5.

The second compensation coefficient may be generated such that the luminance of the grayscale data having the smaller grayscale ratio may be increased, and the luminance of the grayscale data having the larger grayscale ratio may be decreased.

In the grayscale ratio of 0 to 1/3, as explained in Equation 4 of FIG. 5, the second compensation coefficient Cb is generated such that the luminance of the grayscale data having the smaller grayscale ratio is increased. Also, in the grayscale ratio of 1/3 to 2/3, the luminance increasing ratio may be calculated as 0. That is, in the grayscale ratio of 1/3 to 2/3, the second compensation coefficient Cb may be calculated as 0. Also, in the grayscale ratio of 2/3 to K, the luminance increasing ratio may be calculated as a negative value. That is, the second compensation coefficient Cb may be calculated to be negative such that the luminance of the grayscale data is decreased as the grayscale ratio is increased in the grayscale ratio of 2/3 to K. K may be determined as a number that is larger than 2/3 and less than 1, or as 1.

For example, the second blue compensation coefficient Cb(B) increasing the luminance of the blue grayscale data B as the grayscale ratio(Kb) is decreased when the grayscale ratio(Kb) of the blue grayscale data(B) is less than 1/3 and decreasing the luminance of the blue grayscale data(B) as the grayscale ratio(Kb) is increased when the grayscale ratio(Kb) is more than 2/3 may be generated. Also, the second red compensation coefficient Cb(R) increasing the luminance of the red grayscale data R as the grayscale ratio(Kr) is decreased when the grayscale ratio(Kr) of the red grayscale data R is less than 1/3 and decreasing the luminance of the red grayscale data(R) as the grayscale ratio(Kb) is increased when the grayscale ratio(Kr) is more than 2/3 may be generated. Likewise, the second green compensation coefficient Cb(G) increasing the luminance of the green grayscale data G as the grayscale ratio(Kg) is decreased when the grayscale ratio Kg of the green grayscale data G is less than 1/3 and decreasing the luminance of the green grayscale data(G) as the grayscale ratio(Kg) is increased when the grayscale ratio (Kg) is more than 2/3 may be generated.

Again referring to FIG. 2, the first compensation coefficient Ca generated in the first compensation coefficient generator 520 and the second compensation coefficient Cb generated in the second compensation coefficient generator 530 are transmitted to the data compensation coefficient generator 540.

The data compensation coefficient generator 540 multiples the first compensation coefficient Ca and the second compensation coefficient Cb to generate the data compensation coefficient Cd.

Equation 5 shows a method of multiplying the first compensation coefficient Ca generated according to Equation 2 of FIG. 4 and the second compensation coefficient Cb generated according to Equation 4 of FIG. 5 to generate the data compensation coefficient Cd.

$$Cd(B) = \left(\frac{255-B}{255} \times \frac{Lb}{100}\right) \times \left(1 - \frac{1}{Kb_{max}} \times Kb\right) \qquad \text{Equation 5)}$$

-continued $$Cd(R)=\left(\frac{255-R}{255}\times\frac{Lr}{100}\right)\times\left(1-\frac{1}{Kr_{max}}\times Kr\right)$$

$$Cd(G)=\left(\frac{255-G}{255}\times\frac{Lg}{100}\right)\times\left(1-\frac{1}{Kg_{max}}\times Kg\right)$$

The data compensation coefficient Cd includes the blue data compensation coefficient Cd(B), the red data compensation coefficient Cd(R), and the green data compensation coefficient Cd(G).

When compensating the color coordinates by controlling the blue grayscale data B and the red grayscale data R, the data compensation coefficient generator 540 may generate the blue data compensation coefficient Cd(B) and the red data compensation coefficient Cd(R).

When compensating the color coordinates by controlling the green grayscale data G as well as the blue grayscale data B and the red grayscale data R, the data compensation coefficient generator 540 may generate the blue data compensation coefficient Cd(B), the red data compensation coefficient Cd(R), and the green data compensation coefficient Cd(G).

The data compensation coefficient generator 540 transmits the data compensation coefficient Cd to the data compensator 550.

The data compensator 550 applies the data compensation coefficient Cd to the luminance data RL, GL, and BL transmitted from the gamma processor 510 to generate the compensation luminance data RL', GL', and BL'.

Equation 6 shows a method of generating the compensation luminance data RL', GL', and BL' by applying the data compensation coefficient Cd to the luminance data RL, GL, and BL.

$$RL'=RL\times(1+Cd(R))$$

$$GL'=GL\times(1+Cd(G))$$

$$BL'=BL\times(1+Cd(B)) \qquad \text{Equation 6)}$$

Here, RL' represents the red compensation luminance data, GL' represents the green compensation luminance data, and BL' represents the blue compensation luminance data.

When compensating the color coordinates by controlling the blue grayscale data B and the red grayscale data R, the data compensator 550 may generate the blue compensation luminance data BL' and the red compensation luminance data RL'.

When compensating the color coordinate by controlling the green grayscale data G as well as the blue grayscale data B and the red grayscale data R, the data compensator 550 may generate the blue compensation luminance data BL', the red compensation luminance data RL', and the green compensation luminance data GL'.

The data compensator 550 transmits the compensation luminance data RL', GL', and BL' to the inverse gamma processor 560.

The inverse gamma processor 560 converts the compensation luminance data RL', GL', and BL' into the compensation grayscale data R', G', and B' by applying the inverse gamma function ($f=x^{1/2.2}$).

Equation 7 shows an example converting the compensation luminance data RL', GL', and BL' into the compensation grayscale data R', G', and B' by applying the inverse gamma function ($f=x^{1/2.2}$).

$$R'=\left(\frac{RL'}{\alpha}\right)^{1/2.2}\times 255$$

$$G'=\left(\frac{GL'}{\alpha}\right)^{1/2.2}\times 255$$

$$B'=\left(\frac{BL'}{\alpha}\right)^{1/2.2}\times 255 \qquad \text{Equation 7)}$$

Here, R' represents the red compensation grayscale data, G' represents the green compensation grayscale data, and B' represents the blue compensation grayscale data.

When compensating the color coordinates by controlling the blue grayscale data B and the red grayscale data R, the inverse gamma processor 560 may generate the blue compensation grayscale data B' and the red compensation grayscale data R'. At this time, the green grayscale data G may be output as the green compensation grayscale data G' as it is without the compensation.

When compensating the color coordinates by controlling the green grayscale data G as well as the blue grayscale data B and the red grayscale data R, the inverse gamma processor 560 may generate the blue compensation grayscale data B', the red compensation grayscale data R', and the green compensation grayscale data G'.

The compensation grayscale data R', G', and B' are input to the signal controller 100 of the display device 10 as the compensation video signal.

As described above, the first compensation coefficient Ca compensating the color coordinate error by the leakage current and the second compensation coefficient Cb compensating the color coordinate error by the load effect are calculated, and the data compensation coefficient Cd is calculated therefrom to apply them to the grayscale data R, G, and B, thereby compensating the color twist by the leakage current and the load effect.

Figure 7:
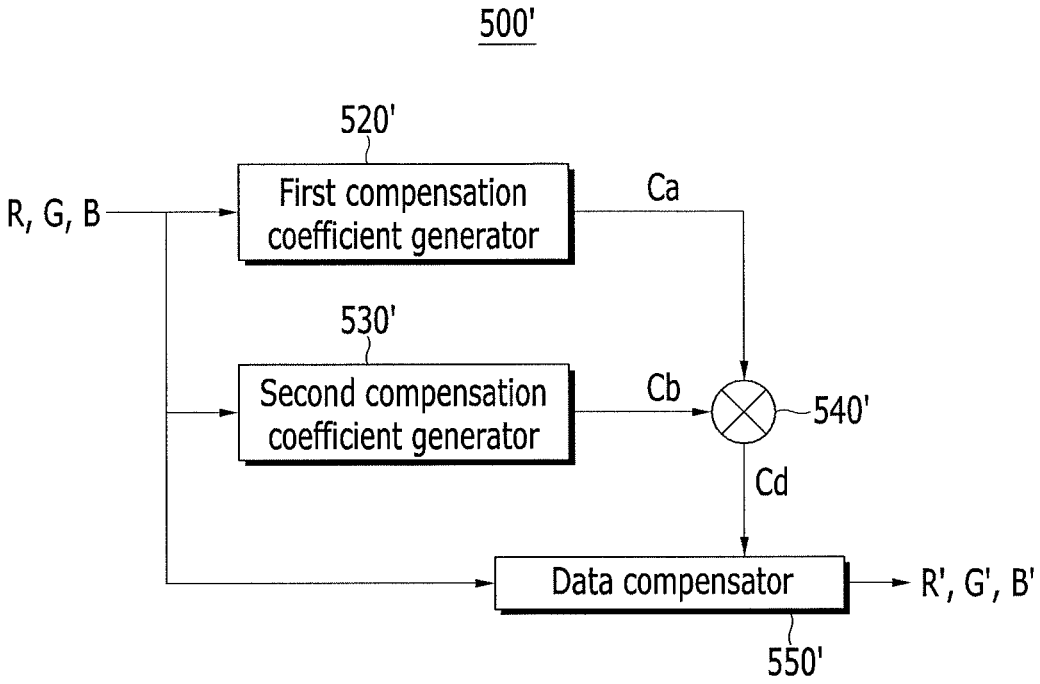
FIG. 7 is a block diagram of a data processing device according to another example embodiment.

FIG. 7 is a block diagram of a data processing device according to another example embodiment.

Referring to FIG. 7, a data processing device 500' includes a first compensation coefficient generator 520', a second compensation coefficient generator 530', a data compensation coefficient generator 540', and a data compensator 550'.

The data processing device 500' of FIG. 7 is a structure in which the gamma processor 510 and the inverse gamma processor 560 are omitted from the data processing device 500 of FIG. 2.

According to the omission of the gamma processor 510, the grayscale data R, G, and B are transmitted to the data compensator 550', and the data compensator 550' applies the data compensation coefficient Cd to the grayscale data R, G, and B.

The process in which the first compensation coefficient Ca is generated in the first compensation coefficient generator 520', the second compensation coefficient Cb is generated in the second compensation coefficient generator 530', and the compensation data coefficient Cd is generated in the data compensation coefficient generator 540' is the same as that described in FIGS. 2 to 6.

Equation 8 represents a method generating the compensation grayscale data R', G', and B' by applying the data compensation coefficient Cd to the grayscale data R, G, and B.

$$R'=R\times(1+Cd(R))$$

$$G'=G\times(1+Cd(G))$$

$$B'=B\times(1+Cd(B)) \qquad \text{Equation 8)}$$

That is, the data compensator 550' generates the compensation grayscale data R', G', and B' by adding the grayscale data R, G, and B to a value of which the data compensation coefficient Cd is multiplied by the grayscale data R, G, and B.

As described above, the gamma processor 510 and the inverse gamma processor 560 are omitted and the data compensation coefficient Cd is applied to the grayscale data R, G, and B to generate the compensation grayscale data R', G', and B' such that the process generating the compensation grayscale data R', G', and B' may be simplified and high speed data processing is enabled.

Figure 8:
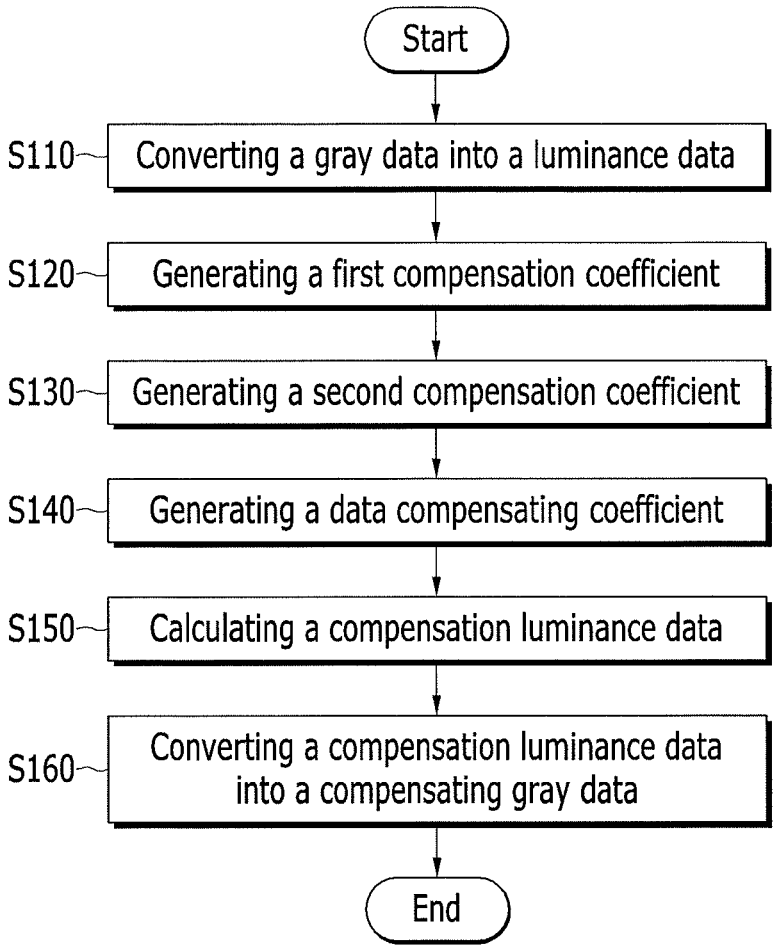
FIG. 8 is a flowchart of a data processing method according to an example embodiment.

FIG. 8 is a flowchart of a data processing method according to an example embodiment.

Referring to FIG. 8, the grayscale data R, G, and B representing the grayscale of the sub-pixel is input, and the grayscale data R, G, and B is converted into the luminance data RL, GL, and BL by applying the gamma function ($f=x^{2.2}$) (S110). The grayscale data R, G, and B may have the grayscale of, e.g., $1024=2^{10}$, $256=2^8$, or $64=2^6$. Here, it is assumed that the grayscale data R, G, and B has a 0-255 grayscale. At this time, the grayscale data R, G, B may be converted into the luminance data RL, GL, BL by Equation 1.

The first compensation coefficient Ca is generated by using the grayscale data R, G, and B (S120). The first compensation coefficient Ca is a compensation coefficient to compensate a phenomenon that the color coordinate error is increased closer to the low grayscale by the leakage current. The first compensation coefficient Ca may be generated to increase the luminance of the blue grayscale data B and the red grayscale data R closer to the low grayscale. Also, the first compensation coefficient Ca may be generated to increase the luminance of the blue grayscale data B, the red grayscale data R, and the green grayscale data G closer to the low grayscale. The first compensation coefficient Ca includes the first blue compensation coefficient Ca(B), the first red compensation coefficient Ca(R), and the first green compensation coefficient Ca(G), and may be generated by Equation 2.

The second compensation coefficient Cb is generated by using the grayscale data R, G, and B (S130). The second compensation coefficient Cb is the compensation coefficient to compensate the phenomenon that the sub-pixel applied with the grayscale data having the small grayscale ratio by the load effect becomes darker and the sub-pixel applied with the grayscale data having the large grayscale ratio becomes brighter. The second compensation coefficient Cb may be generated to the luminance of the grayscale data having the smaller grayscale ratio. Also, the second compensation coefficient Cb may be generated to the luminance of the grayscale data having the smaller grayscale ratio and to decrease the luminance of the grayscale data having the higher grayscale ratio. The second compensation coefficient Cb includes the second blue compensation coefficient Cb(B), the second red compensation coefficient Cb(R), and the second green compensation coefficient Cb(G), and may be generated by Equation 4.

The first compensation coefficient Ca and the second compensation coefficient Cb are multiplied to generate the data compensation coefficient Cd (S140). The data compensation coefficient Cd includes the blue data compensation coefficient Cd(B), the red data compensation coefficient Cd(R), and the green data compensation coefficient Cd(G), and may be generated by Equation 5.

The compensation luminance data RL', GL', and BL' are calculated by applying the data compensation coefficient Cd to the calculation luminance data RL, GL, and BL (S150). As shown in Equation 6, the compensation luminance data RL', GL', and BL' may be calculated by adding the luminance data RL, GL, and BL to the value of which the data compensation coefficient Cd is multiplied to the luminance data RL, GL, and BL. At this time, only the blue compensation luminance data BL' and the red compensation luminance data RL' are generated, and the green compensation luminance data GL' may not be generated. That is, the compensation for the green may not be performed.

The inverse gamma function ($f=x^{1/2.2}$) is applied to the compensation luminance data RL', GL', and BL' to convert the compensation luminance data RL', GL', and BL' into the compensation grayscale data R', G', and B' (S160). When compensating the color coordinates by controlling the blue grayscale data B and the red grayscale data R, only the blue compensation grayscale data B' and the red compensation grayscale data R' are generated and the green compensation grayscale data G' may be output without the amendment of the green grayscale data G.

By way of summation and review, an organic light emitting diode (OLED) display may include a plurality of pixels made of a red sub-pixel, a green sub-pixel, and a blue sub-pixel. A light emitting color of the pixel may be determined by a spatial or temporal sum of the light emitted from the red sub-pixel, the green sub-pixel, and the blue sub-pixel.

Each sub-pixel may include an organic light emitting diode (OLED), a driving transistor controlling a current amount supplied to the organic light emitting diode (OLED), and a switching transistor transmitting a data voltage controlling a light emitting amount of the organic light emitting diode (OLED) to the driving transistor. If a leakage current is generated in the switching transistor, the data voltage transmitted to the driving transistor may be transmitted as an unwanted voltage. By the leakage current, the pixel may abnormally emit light such that a color twist (in which a balance of red, green, and blue is twisted) is generated. This twist may be exhibited more in blue and red than green.

Also, as size of the organic light emitting diode (OLED) display is increased, a number of loads may be increased such that the color twist is generated by a load effect such that luminance is decreased. A result that the color to be displayed in the organic light emitting diode (OLED) display is not correct may thus caused by the color twist even though the color may be correctly realized.

As described above, embodiments relate to an active matrix organic light emitting diode (OLED) display, a data processing device thereof, and a method thereof. Embodiments may provide a display device compensating a color twist due to a leakage current and a load effect, a data processing device for the same, and a driving method thereof. Color twist from the leakage current and the load effect may be improved, and thereby the display quality of the display device may be improved.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

<Description of Symbols>

500: data processing device 510: gamma processor
520: first compensation coefficient generator
530: second compensation coefficient generator
540: data compensation coefficient generator
550: data compensator 560: inverse gamma processor

What is claimed is:

1. A data processing device, comprising:

a gamma processor applying a gamma function to grayscale data including red grayscale data, green grayscale data, and blue grayscale data to generate luminance data including red luminance data, green luminance data, and blue luminance data;

a first compensation coefficient generator generating a first compensation coefficient increasing luminance of the grayscale data as a grayscale decreases;

a second compensation coefficient generator calculating a first grayscale ratio of the blue grayscale data and a second grayscale ratio of the red grayscale data for a sum of a grayscale of green grayscale data, blue grayscale data, and red grayscale data, and generating a second compensation coefficient increasing luminance of the blue grayscale data as the first grayscale ratio is decreased and increasing luminance of the red grayscale data as the second grayscale ratio becomes smaller;

a data compensation coefficient generator generating a data compensation coefficient by multiplying the first compensation coefficient and the second compensation coefficient;

a data compensator generating compensation luminance data by adding the luminance data to a value of the data compensation coefficient multiplied by the luminance data; and an inverse processor generating compensation grayscale data by applying an inverse gamma function to the compensation luminance data.

2. The data processing device as claimed in claim 1, wherein the first compensation coefficient includes the first blue compensation coefficient for the blue grayscale data and the first red compensation coefficient for the red grayscale data.

3. The data processing device as claimed in claim 2, wherein the first compensation coefficient further includes the first green compensation coefficient for the green grayscale data.

4. The data processing device as claimed in claim 1, wherein the second compensation coefficient includes the second blue compensation coefficient generated when the first grayscale ratio is less than 1/3.

5. The data processing device as claimed in claim 1, wherein the second compensation coefficient includes the second red compensation coefficient generated when the second grayscale ratio is less than 1/3.

6. The data processing device as claimed in claim 1, wherein the second compensation coefficient generator calculates the third grayscale ratio of the green grayscale data for the sum of the grayscale and generates the second green compensation coefficient increasing the luminance of the green grayscale data as the third grayscale ratio is decreased.

7. The data processing device as claimed in claim 6, wherein the second green compensation coefficient is generated when the third grayscale ratio is less than 1/3.

8. The data processing device as claimed in claim 1, wherein the second compensation coefficient generator calculates the third grayscale ratio of the green grayscale data for the sum of the grayscale and generates the second green compensation coefficient increasing the luminance of the green grayscale data as the third grayscale ratio is decreased when the third grayscale ratio is less than 1/3, and decreasing the luminance of the green grayscale data as the third grayscale ratio is increased when the third grayscale ratio is more than 2/3.

9. The data processing device as claimed in claim 1, wherein the second compensation coefficient includes the second blue compensation coefficient increasing the luminance of the blue grayscale data as the first grayscale ratio is decreased when the first grayscale ratio is less than 1/3, and decreasing the luminance of the blue grayscale data as the first grayscale ratio is increased when the first grayscale ratio is more than 2/3.

10. The data processing device as claimed in claim 1, wherein the second compensation coefficient includes the second red compensation coefficient including the luminance of the red grayscale data as the second grayscale ratio is decreased when the second grayscale ratio is less than 1/3, and decreasing the luminance of the red grayscale data as the second grayscale ratio is increased when the second grayscale ratio is more than 2/3.

11. A data processing device, comprising:

a first compensation coefficient generator generating a first compensation coefficient increasing luminance of a grayscale data as a grayscale decreases;

a second compensation coefficient generator calculating a first grayscale ratio of blue grayscale data and a second grayscale ratio of red grayscale data for a sum of a grayscale of green grayscale data, blue grayscale data, and red grayscale data included in the grayscale data, and generating a second compensation coefficient increasing luminance of the blue grayscale data as the first grayscale ratio is decreased and increasing luminance of the red grayscale data as the second grayscale ratio becomes smaller;

a data compensation coefficient generator generating a data compensation coefficient by multiplying the first compensation coefficient and the second compensation coefficient; and a data compensator generating compensation luminance data by adding luminance data to a value of the data compensation coefficient multiplied by the luminance data.

12. A method of processing data, comprising:

applying a gamma function to grayscale data to generate luminance data;

generating a first compensation coefficient increasing luminance of the grayscale data as a grayscale decreases;

calculating a first grayscale ratio of one of blue grayscale data and red grayscale data for a sum of a grayscale of green grayscale data, blue grayscale data, and red grayscale data, and generating a second compensation coefficient increasing luminance of one of the blue grayscale data and the red grayscale data as the first grayscale ratio is decreased;

multiplying the first compensation coefficient and the second compensation coefficient to generate a data compensation coefficient;

adding the luminance data to a value of the data compensation coefficient multiplied by the luminance data to generate compensation luminance data; and applying an inverse gamma function to the compensation luminance data to generate compensation grayscale data.

13. The method as claimed in claim 12, wherein the generating of the first compensation coefficient includes generating a first blue compensation coefficient for the blue grayscale data and a first red compensation coefficient for the red grayscale data.

14. The method as claimed in claim 13, wherein the generating of the first compensation coefficient includes generating a first green compensation coefficient for the green grayscale data.

15. The method as claimed in claim 12, wherein the generating of the second compensation coefficient includes generating a second compensation coefficient increasing luminance of one of the blue grayscale data and the red grayscale data as the first grayscale ratio is decreased when the first grayscale ratio is less than 1/3.

16. The method as claimed in claim 15, wherein the generating of the second compensation coefficient includes generating a second compensation coefficient decreasing the luminance of one of the blue grayscale data and the red grayscale data as the first grayscale ratio is increased when the first grayscale ratio is more than 2/3.

17. The method as claimed in claim 12, wherein the generating of the second compensation coefficient includes calculating the second grayscale ratio of the other of the blue grayscale data and the red grayscale data for the sum of the grayscale of the red grayscale data, the green grayscale data, and the blue grayscale data included the grayscale data, and generating the second compensation coefficient increasing the luminance of the other of the blue grayscale data and the red grayscale data as the second grayscale ratio is decreased when the second grayscale ratio is less than 1/3.

18. The method as claimed in claim 17, wherein the generating of the second compensation coefficient includes generating the second compensation coefficient decreasing the luminance of the other of the blue grayscale data and the red grayscale data as the second grayscale ratio is increased when the second grayscale ratio is more than 2/3.

19. The method as claimed in claim 12, wherein the generating of the second compensation coefficient includes calculating a third grayscale ratio of the green grayscale data for the grayscale sum, and generating the second compensation coefficient increasing the luminance of the green grayscale data as the third grayscale ratio is decreased when the third grayscale ratio is less than 1/3.

20. The method as claimed in claim 19, wherein the generating of the second compensation coefficient further includes generating the second compensation coefficient decreasing the luminance of the green grayscale data as the third grayscale ratio is increased when the third grayscale ratio is more than 2/3.

21. A display device, comprising:

a plurality of pixels; and a data processor generating compensation grayscale data by compensating grayscale data for an image display in the plurality of pixels, wherein the data processor generates a first compensation coefficient increasing luminance of the grayscale data as a grayscale decreases, calculates a first grayscale ratio of blue grayscale data and a second grayscale ratio of red grayscale data for a grayscale sum of red grayscale data, green grayscale data, and blue grayscale data included in the grayscale data, generates a second compensation coefficient increasing luminance of the blue grayscale data as the first grayscale ratio is decreased and increasing luminance of the red grayscale data as the second grayscale ratio is decreased, generates a data compensation coefficient by multiplying the first compensation coefficient and the second compensation coefficient, and compensates the grayscale data by using the data compensation coefficient.

22. The display device as claimed in claim 21, wherein the data processor generates the luminance data by applying a gamma function to the grayscale data, adds luminance data to a value of the data compensation coefficient multiplied by the luminance data to generate the compensation luminance data, and applies an inverse gamma function to compensation luminance data to generate the compensation grayscale data.

23. The display device as claimed in claim 21, wherein the data processor adds the grayscale data to a value of the data compensation coefficient multiplied by the grayscale data to generate the compensation grayscale data.

* * * * *